US011085606B2

(12) United States Patent
Sieber et al.

(10) Patent No.: US 11,085,606 B2
(45) Date of Patent: Aug. 10, 2021

(54) HEAT SINK AND VEHICLE HEADLIGHT

(71) Applicant: ZKW GROUP GMBH, Wieselburg (AT)

(72) Inventors: Lukas Sieber, Pöchlarn (AT); Gunter Karlinger, Bergland (AT); Clemens Hauer, Steinakirchen am Forst (AT); Mathias Schragl, Zarnsdorf (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 16/630,914

(22) PCT Filed: Jul. 16, 2018

(86) PCT No.: PCT/AT2018/060150
§ 371 (c)(1),
(2) Date: Jan. 14, 2020

(87) PCT Pub. No.: WO2019/018867
PCT Pub. Date: Jan. 31, 2019

(65) Prior Publication Data

US 2020/0232621 A1 Jul. 23, 2020

(30) Foreign Application Priority Data

Jul. 28, 2017 (AT) ..... A 50631/2017

(51) Int. Cl.
*F21S 45/47* (2018.01)
*F21V 29/78* (2015.01)

(52) U.S. Cl.
CPC ..... *F21S 45/47* (2018.01); *F21V 29/78* (2015.01)

(58) Field of Classification Search
CPC ..... F21S 45/47; F21S 45/48; F21S 41/141; F21S 45/49; F21V 29/78; F28F 3/00; H01L 33/642
See application file for complete search history.

(56) References Cited

U.S. PATENT DOCUMENTS 5,727,622 A * 3/1998 Gurevich ..... F28F 13/003 165/122
7,712,926 B2 5/2010 Matheson
(Continued)

FOREIGN PATENT DOCUMENTS

CN 204901701 U 12/2015
DE 102012106000 A1 1/2014
(Continued)

OTHER PUBLICATIONS

Office Action for Austrian Application No. A 50631/2017, dated Feb. 28, 2018 (2 pages).
(Continued)

*Primary Examiner* — Rajarshi Chakraborty
*Assistant Examiner* — Fatima N Farokhrooz
(74) *Attorney, Agent, or Firm* — Eversheds Sutherland (US) LLP

(57) ABSTRACT

A heat sink (140) for cooling an electronic component of a vehicle headlamp, which has a cooling structure with an outer contour, which, as viewed along an imagined sectional plane, follows a contour curve, which can be described in at least one section by means of a contour function, wherein a fundamental course is formed from a first superposition of a base function and a fundamental function, and the contour function is formed from a second superposition of the fundamental course and a superposition function, wherein the first superposition takes place in that the functional course of the base function forms an axis of a curved coordinate system of the fundamental function, and the second superposition takes place in that the functional course of the fundamental function forms an axis of a curved coordinate system of the superposition function, wherein the base function has a straight, circular or arc-like course, and
(Continued)

Figure 1:
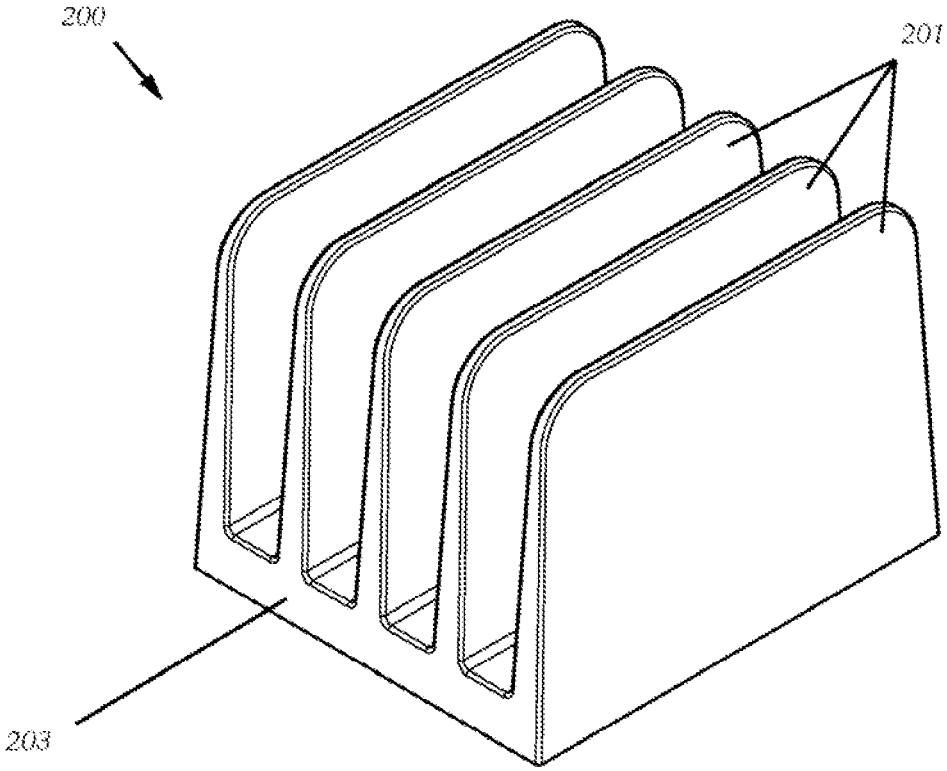

the fundamental function has a straight or wave-like course, and the superposition function has a wave-like course.

9 Claims, 9 Drawing Sheets

(56) References Cited

U.S. PATENT DOCUMENTS

2006/0289152 A1* 12/2006 Leuschner ..... F28F 1/126 165/152
2007/0097692 A1 5/2007 Suehiro
2008/0068839 A1* 3/2008 Matheson ..... F21V 29/75 362/249.07
2008/0186724 A1* 8/2008 Lynam ..... B60Q 1/2665 362/494
2010/0110699 A1* 5/2010 Chou ..... F21S 8/026 362/365
2011/0032697 A1 2/2011 Hu et al.
2011/0067841 A1* 3/2011 Doo ..... H05K 7/20254 165/104.19
2011/0079370 A1* 4/2011 Wen ..... F28F 13/00 165/80.3
2013/0032323 A1* 2/2013 Hsu ..... F28F 3/02 165/185
2013/0327513 A1* 12/2013 Franz ..... F28F 21/04 165/185
2014/0022801 A1* 1/2014 Yang ..... F21V 29/75 362/382
2014/0345136 A1* 11/2014 Lin ..... F28F 3/06 29/890.03
2015/0070881 A1* 3/2015 Hwu ..... F21V 29/76 362/218
2017/0219182 A1 8/2017 Duarte et al.
2018/0291844 A1* 10/2018 Lee ..... F28F 1/40
2018/0340682 A1* 11/2018 Tessnow ..... F21V 29/89

FOREIGN PATENT DOCUMENTS

DE 102012106003 A1 1/2014
WO 2011025235 A2 3/2011
WO 2011134121 A1 11/2011

OTHER PUBLICATIONS

International Preliminary Report on Patentability for PCT/AT2018/060150, dated Oct. 29, 2019 (20 pages).

* cited by examiner

HEAT SINK AND VEHICLE HEADLIGHT

The invention relates to a heat sink for cooling an electronic component of a vehicle headlamp, wherein the heat sink has a cooling structure with an outer contour, which, as viewed along an imagined sectional plane, follows a contour curve, which can be described in at least one section by means of a contour function.

In many applications, heat, which is generated for example by means of power loss of power electronics, must be dissipated in a suitable manner. Heat sinks are often used to this end, which are connected to the heat source, in order to enlarge the heat-emitting surface of a heat-producing component. As a result, possible damage due to overheating should be prevented.

The heat transfer from a heat source to the surrounding cooling medium (for the most part air, but also water or other liquids) is primarily dependent on the temperature difference, the effective surface area and the flow velocity of the cooling medium. A heat sink has the object of conducting lost heat away from the heat-generating component by thermal conduction and then discharging the same by thermal radiation and/or convection of the heat sink to the surroundings. In order to keep the thermal resistance as low as possible, the heat sink should consist of material which conducts heat well and have a dark and largest possible surface area. Vertical mounting may support air circulation by means of the chimney effect.

During installation of a heat sink in a vehicle, particularly in a vehicle headlamp, further aspects come into effect, such as for example the installation volume, the installation weight, the production method or the material. In addition, costs for design, production and mounting are very important.

It is an object of the invention to create a heat sink, which is particularly well suited for installation in a vehicle headlamp and improves the thermal properties.

The object is achieved by means of a heat sink, in that a fundamental course is formed from a first superposition of a base function and a fundamental function, and the contour function is formed from a second superposition of the fundamental course and a superposition function, wherein the first superposition takes place in that the functional course of the base function forms an axis of a curved, preferably orthogonal coordinate system of the fundamental function, and the second superposition takes place in that the functional course of the fundamental function forms an axis of a curved, preferably orthogonal coordinate system of the superposition function, wherein the base function has a straight, circular or arc-like course, and the fundamental function has a straight or wave-like course, and the superposition function has a wave-like course.

In this context, a wave-like course means a course, which can be described by means of a function, which for example corresponds to a sine function, a triangular function, a sawtooth function or a periodically running semicircle function. Other periodic functions are also possible, particularly those which correspond to the value of a periodically running function. Consequently, according to the previously mentioned examples, a value of a sine function is also possible. For the course, it is advantageous if at least ten, preferably thirty, particularly preferably fifty periods of the function form the wave-like course.

As a result, it is achieved that the heat sink has a considerably enlarged surface area and at the same time, the flow of the convection of the warm, rising air or the cooling medium is improved. As a result, there is an improvement of the efficiency of the heat sink. In other words, given an identical thermal efficiency, a heat sink may have a smaller volume or a lower weight due to a larger surface area for heat dissipation and better convection properties, which is advantageous for heat sinks of a vehicle headlamp in particular.

The inventors have surprisingly determined that, by means of a special design of the shaping of a heat sink or the surface thereof, the thermal efficiency can be improved considerably beyond the prior art. In other words, the installation volume and the weight can be reduced, which may lead to lower costs.

In particular, when using heat sinks in vehicle headlamps, in which the installation size and installation mass are important, the thermal efficiency achieved may contribute to a beneficial conception of a heat sink.

In this context, the base function, the fundamental function and the superposition function may be described by means of a curved coordinate system. In a preferred embodiment, the axes of these curved coordinate systems are orientated normal to one another in the origin thereof. Curved coordinates are coordinate systems in Euclidean space, in which the coordinate lines can be curved and which are diffeomorphic to Cartesian coordinates.

The coordinate axes are defined as tangents on coordinate lines. As the coordinate lines are generally curved, the coordinate axes are not spatially fixed, as is the case for Cartesian coordinates.

The effect of the invention can be strengthened if the heat sink has a base, on which at least two ribs or at least two pins are arranged, which are arranged substantially parallel to one another. As a result, a chimney effect is created between two opposite surfaces of two cooling ribs or cooling pins, which additionally improves the convection of the cooling medium together with the surface design according to the invention. The parallel arrangement also has advantages during manufacturing.

In this context, "arranged substantially parallel" means that, for example, two geometric centre lines of two adjacent cooling ribs, which run in the direction of the longitudinal extent of the cooling rib and preferably transversely to the base, enclose an angle with respect to one another, which is smaller than 10°, preferably smaller than 5° and particularly preferably smaller than 1°. A parallel arrangement of cooling pins corresponds to a matrix-like arrangement.

It is additionally beneficial if the contour function describes at least parts of two opposite sides of the outer contour of at least a part of the heat sink, that is for example a rib or a pin, wherein the sides have a spacing from one another and the superposition function has a periodic course with a superposition period length, wherein the superposition period length is preferably at most half as long, particularly preferably at most a third as long, as the spacing. As a result, it can be achieved, that the convection flow of the cooling medium is further strengthened.

The inventors have additionally noted that the thermal efficiency is particularly good if the cooling ribs are shaped according to a linear base function, a linear fundamental function and a sinusoidal superposition function, wherein the superposition period length is preferably at most a third as long as the spacing.

The inventors have observed a further improvement of the thermal efficiency if the cooling ribs are shaped according to a linear base function, a linear fundamental function and a triangular superposition function, wherein the superposition period length is preferably at most a third as long as the spacing.

The inventors have observed an additional improvement of the thermal efficiency if the cooling ribs are shaped according to a linear base function, a wave-like fundamental function and a triangular superposition function, wherein the superposition period length is preferably at most a third as long as the spacing.

In this context, the outer contour of the heat sink means the shaping of the surface of the heat sink.

Further, it is noted that the base, fundamental and/or superposition function, for example in the case of a wave-like or triangular course, extend horizontally to the base of the respective heat sink, as is illustrated for example in the figures.

Furthermore, it is noted that the corners of a triangular function, for example a triangular superposition function, may also be substantially rounded.

It is particularly beneficial if the ribs or pins have a spacing between opposite parts of the outer contour, and the superposition function has a periodic course with a superposition period length, wherein the superposition period length is preferably at most half as long, particularly preferably at most a third as long, as the spacing. The inventors have surprisingly noticed that the flow of the thermal convection on the surface of the heat sink can be improved considerably and the heat sink can be configured more efficiently by means of this embodiment.

In a preferred embodiment of the invention, the fundamental function has a periodic course with a fundamental period length and the superposition function has a periodic course with a superposition period length, wherein the fundamental period length is at least preferably five-times as long, particularly preferably ten-times as long, as the superposition period length. The inventors have surprisingly further noticed that the flow of the thermal convection on the surface of the heat sink can be improved further and the efficiency of the heat sink is particularly good due to this embodiment.

In a particularly preferred embodiment of the invention, the fundamental function and the superposition function run differently in each case, either in a wave-like manner, from the value of wave-like or triangular. The inventors have surprisingly determined beyond the previously mentioned aspects, that the flow of the thermal convection on the surface of the heat sink can be optimized further and the efficiency of the heat sink is particularly good due to this embodiment.

A beneficial embodiment of the invention has a vehicle headlamp, which comprises a lamp and/or power electronics, a heat sink according to the invention and an optical system. The lamp and/or the power electronics is/are coupled to the heat sink. As a result, it is possible that a vehicle headlamp is created, which has particular advantages with regards to installation volume, installation weight, production method and costs for design, production and mounting.

Figure 1A:
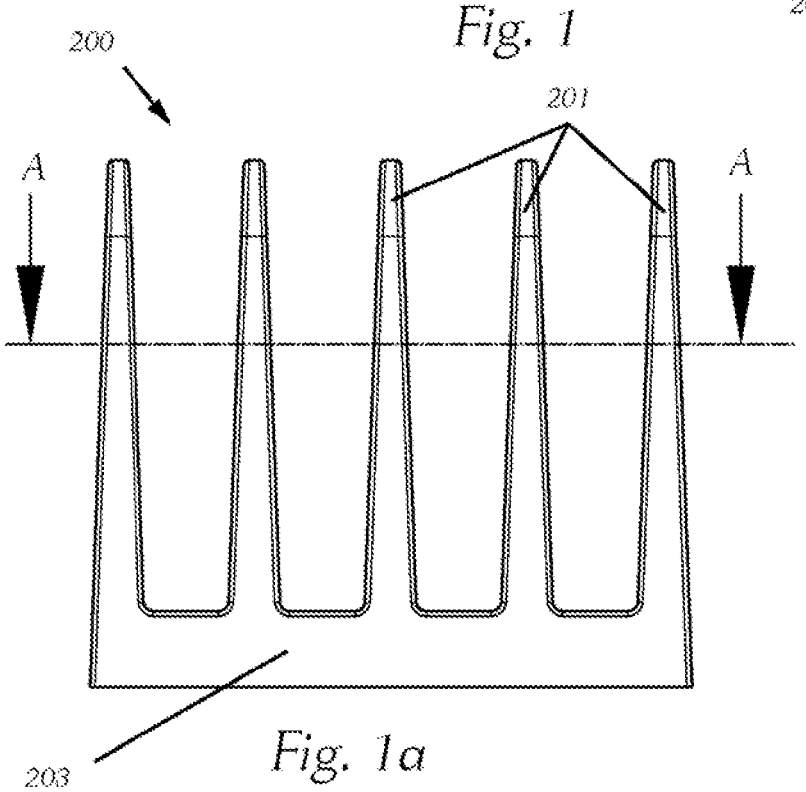
Figure 1B:
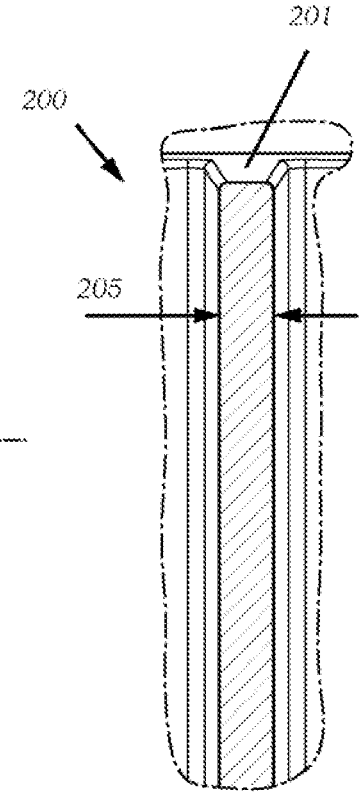
Figure 2:
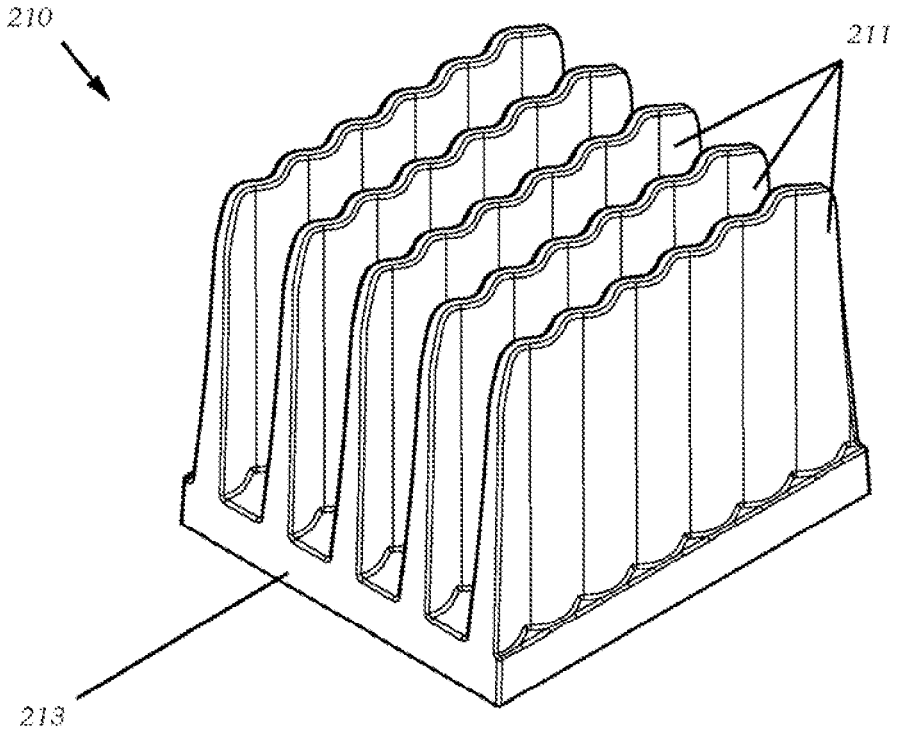
Figure 2A:
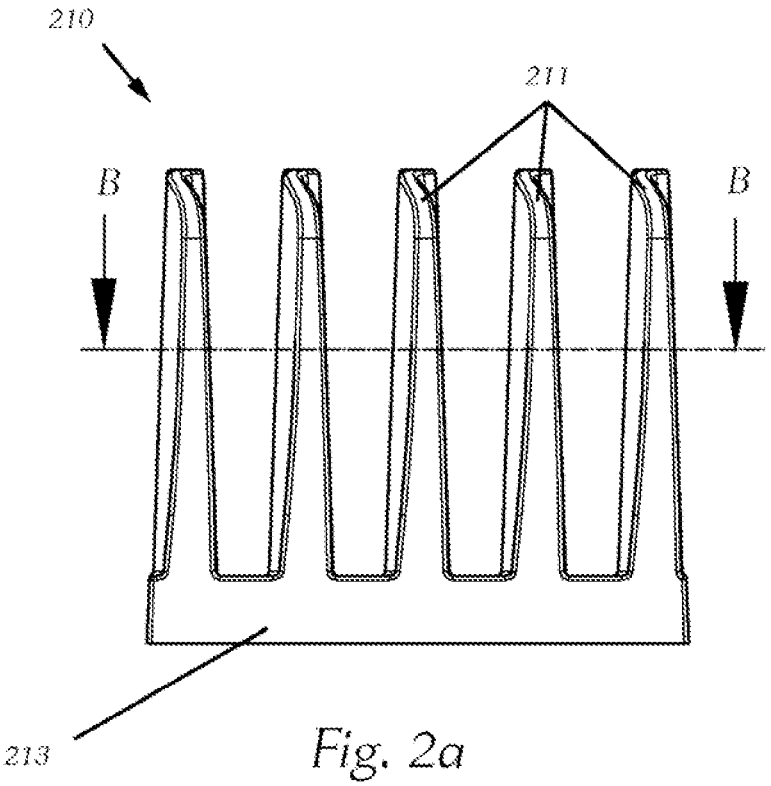
Figure 2B:
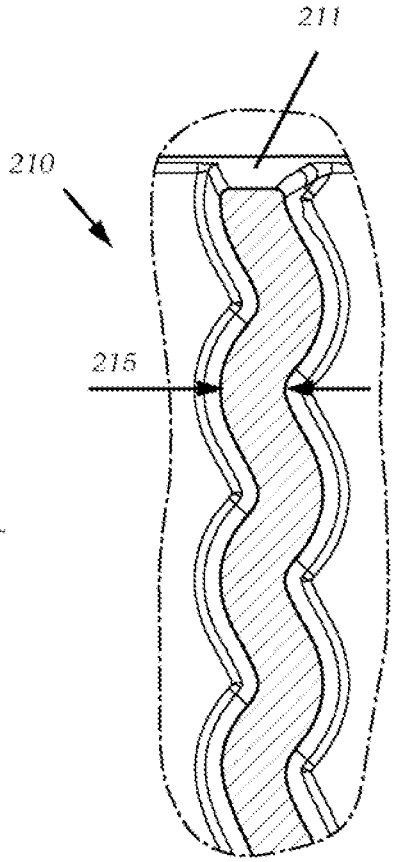
Figure 3:
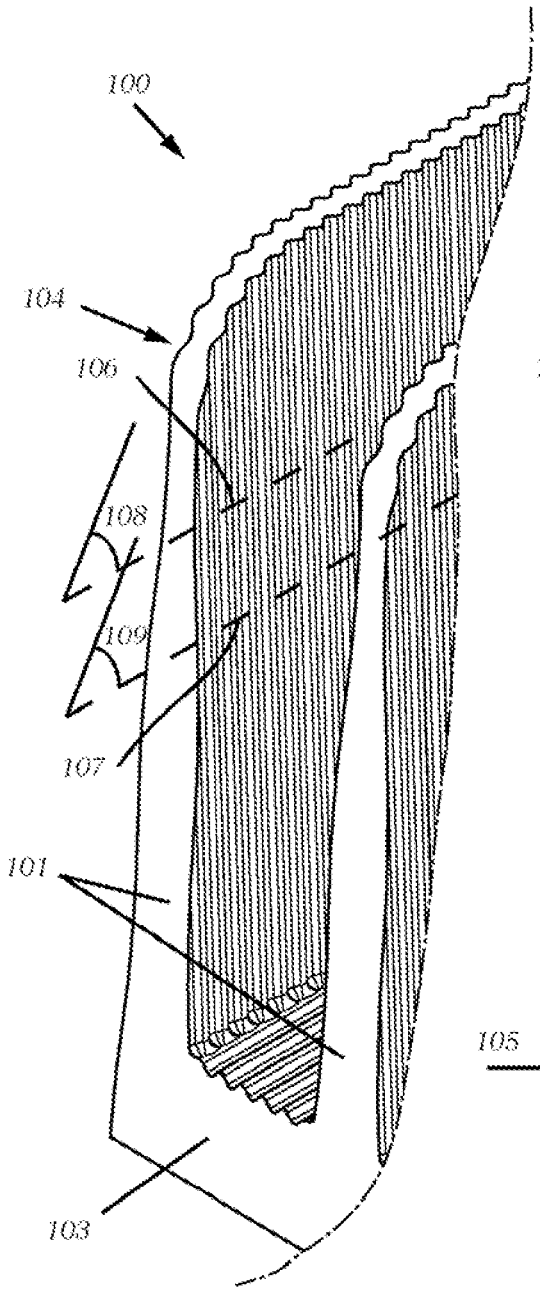
Figure 3A:
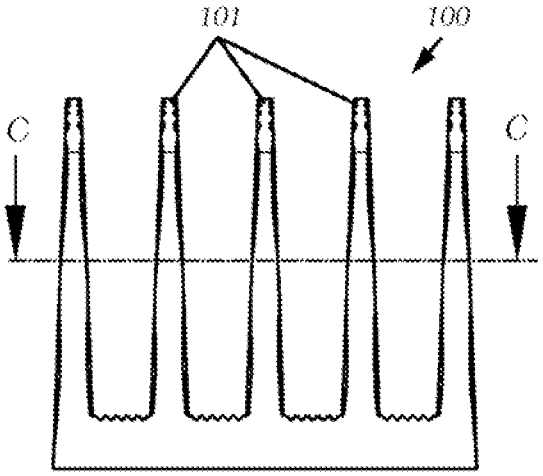
Figure 3B:
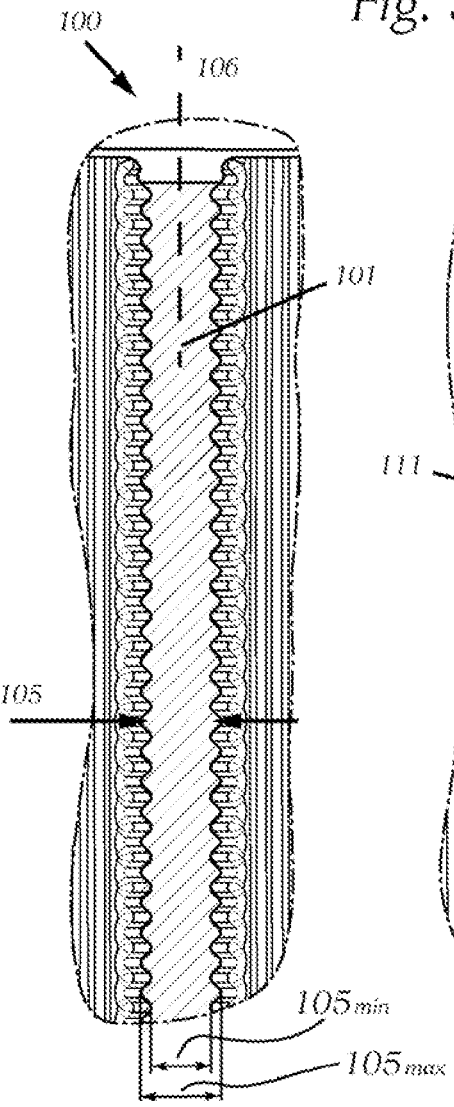
Figure 3C:
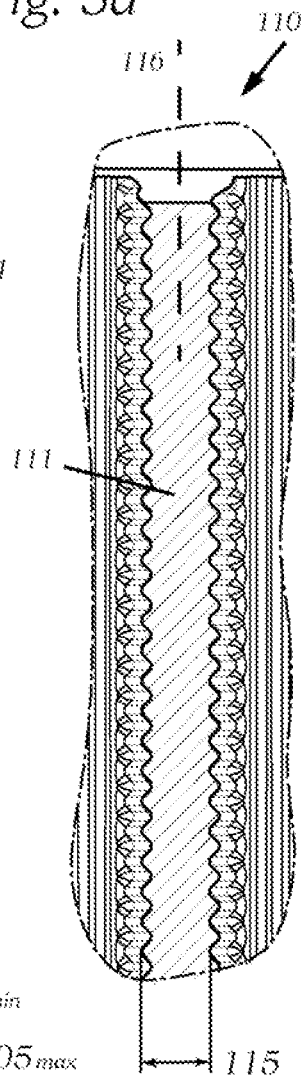
Figure 4:
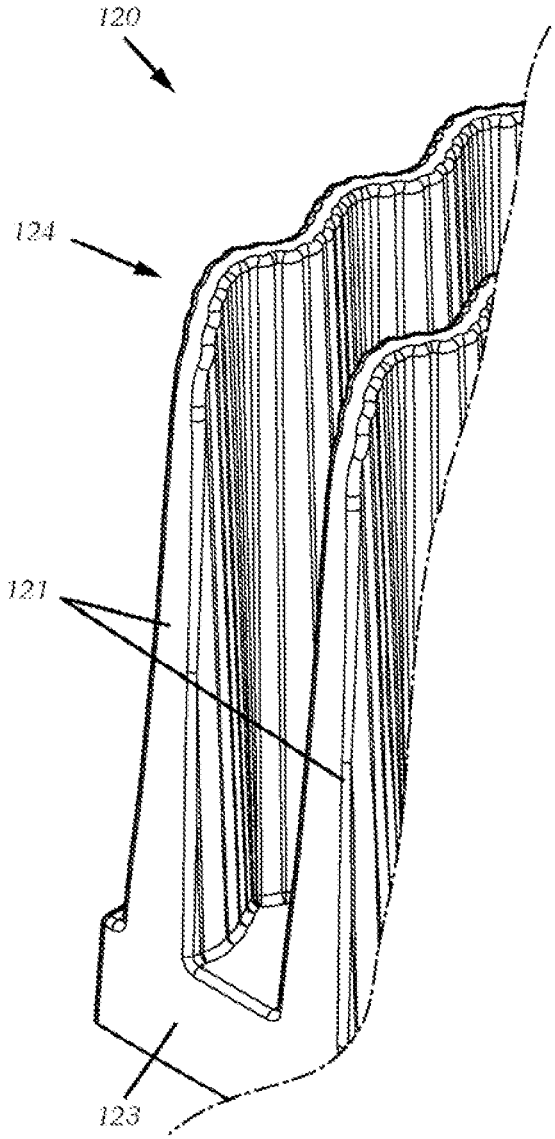
Figure 4A:
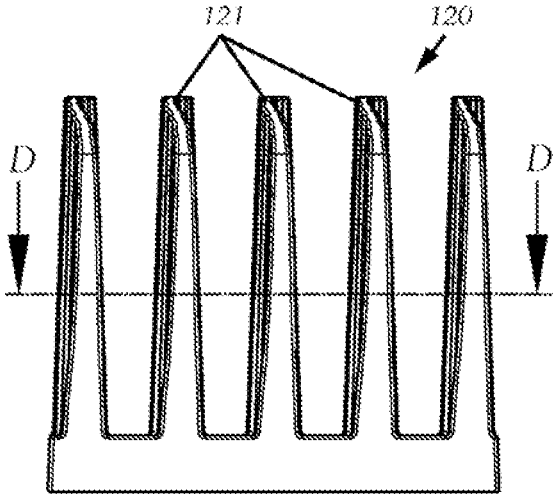
Figure 4B:
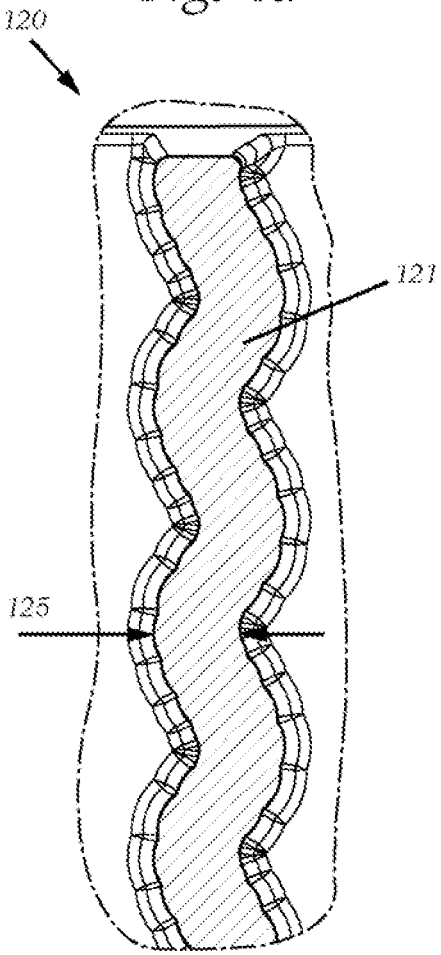
Figure 4C:
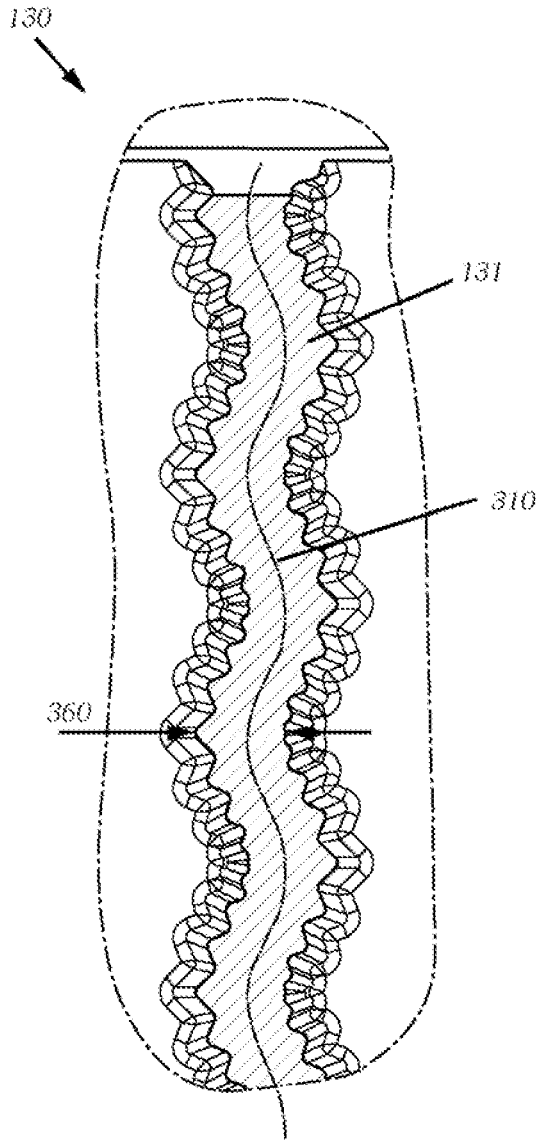
Figure 4D:
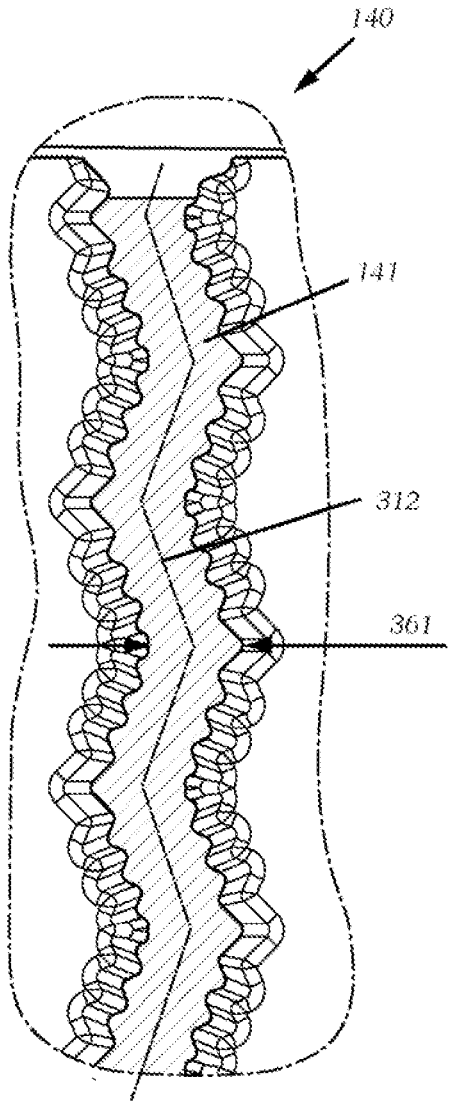
Figure 4E:
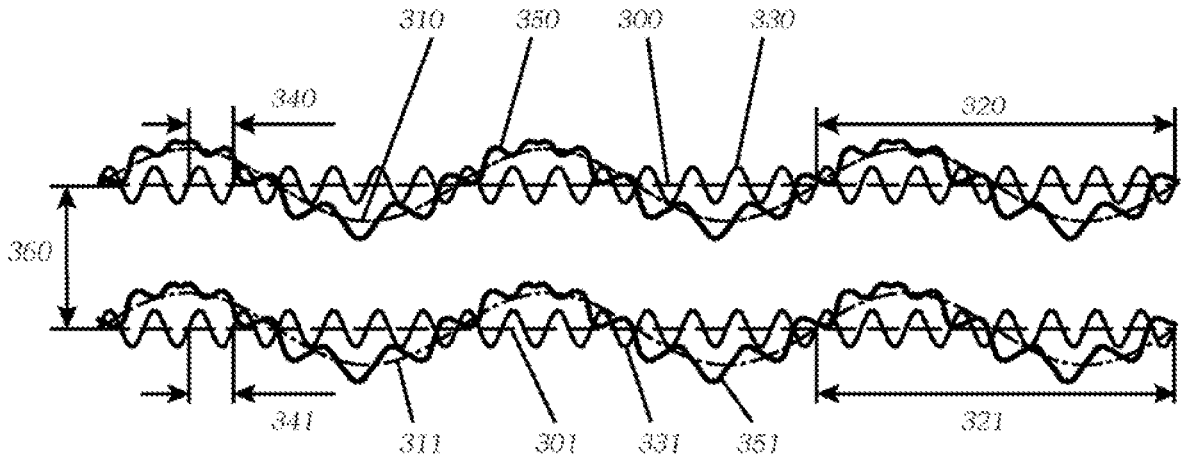
Figure 4F:
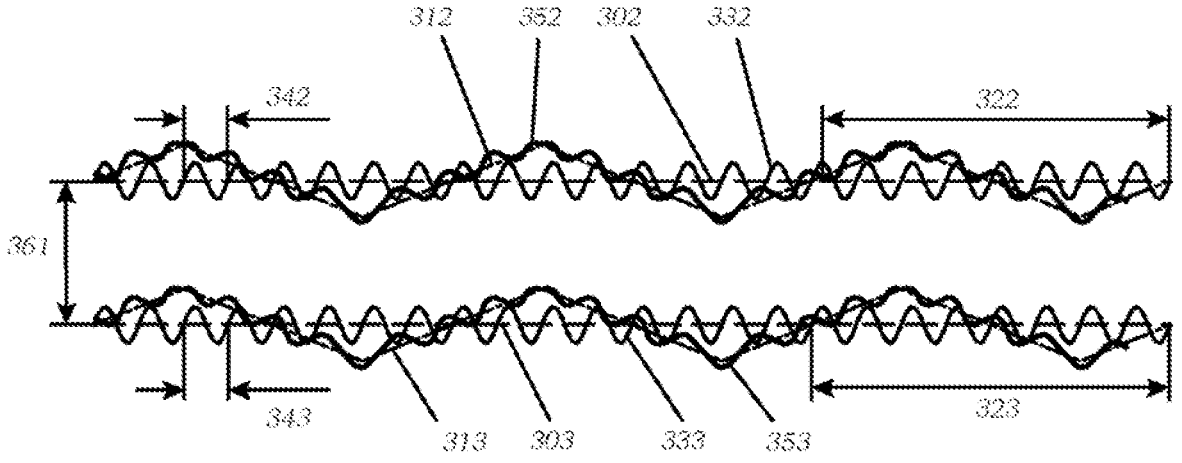
Figure 5:
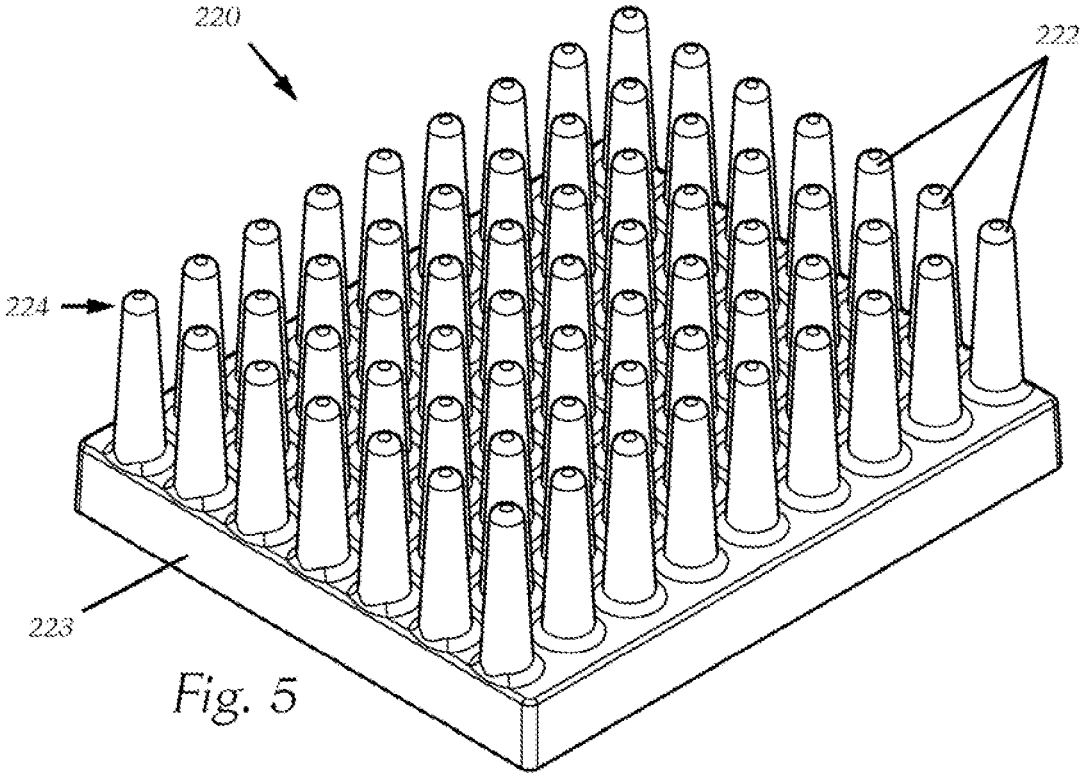
Figure 5A:
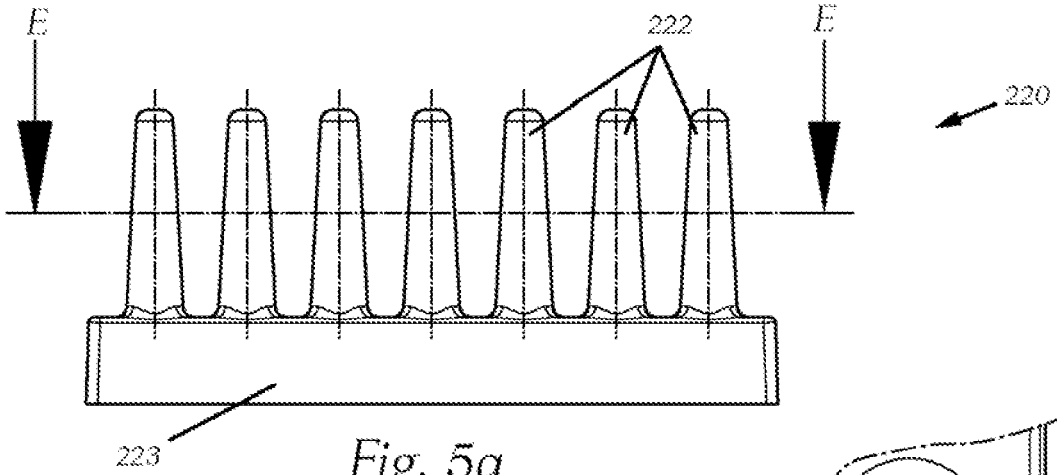
Figure 5B:
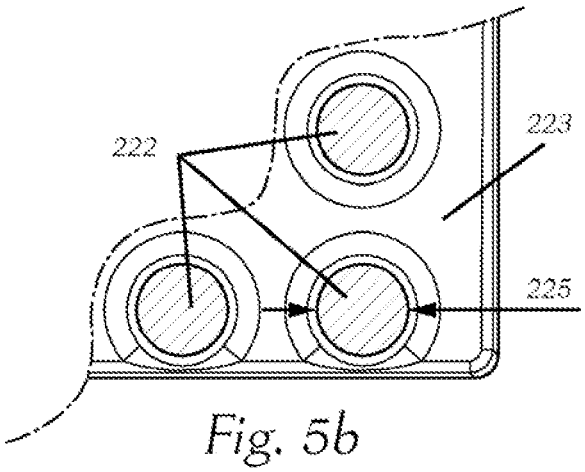
Figure 6:
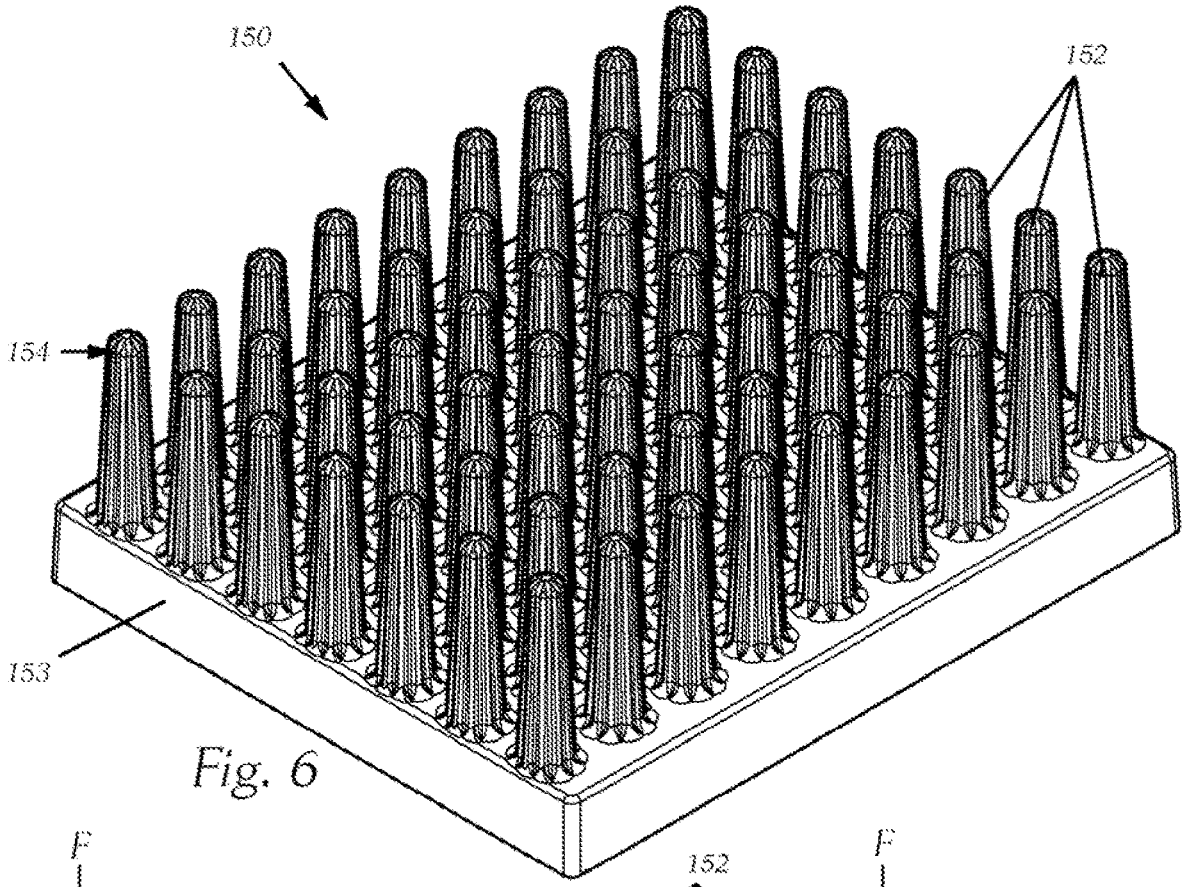
Figure 6A:
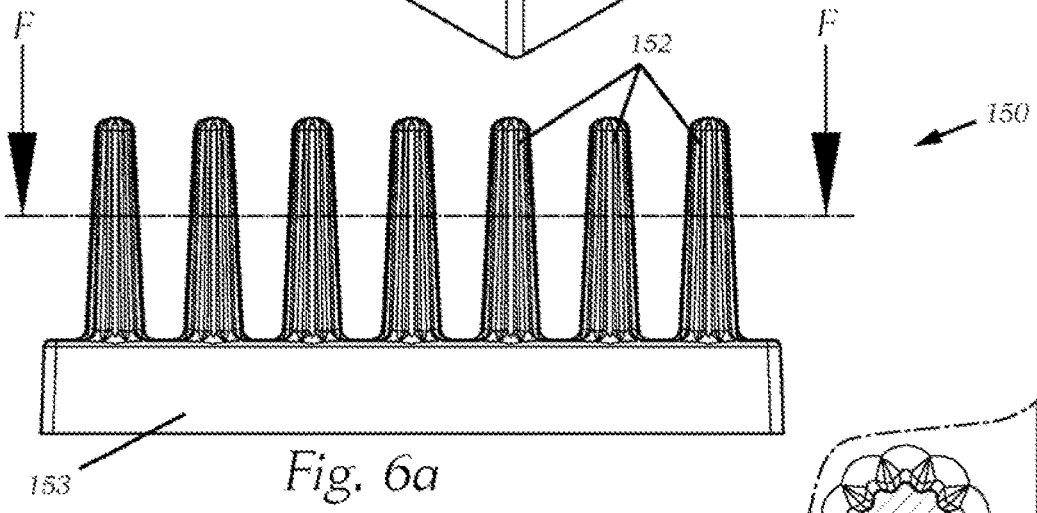
Figure 6B:
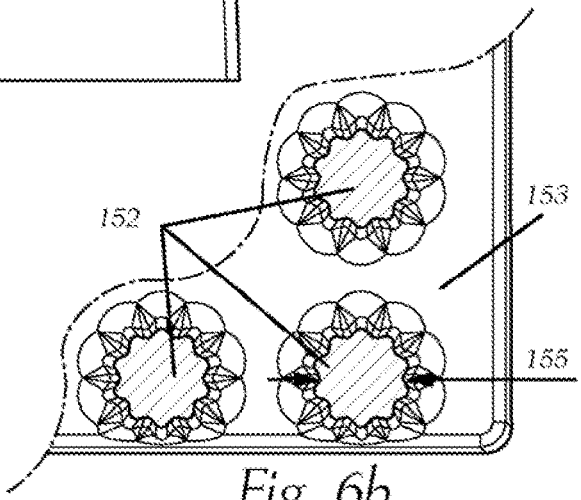
Figure 7:
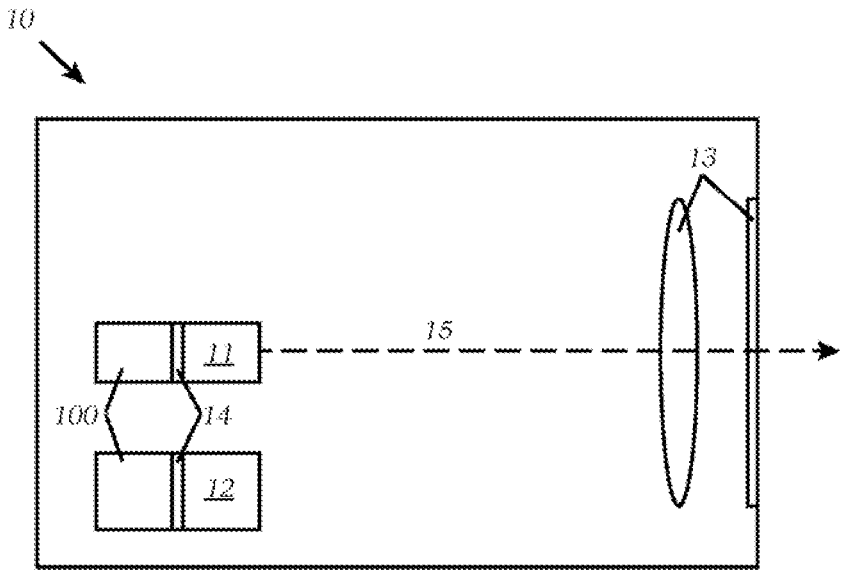

The invention and the advantages thereof are described in more detail hereinafter on the basis of non-limiting exemplary embodiments, which are illustrated in the attached drawings. In the drawings FIG. 1 shows a perspective view of a heat sink according to the prior art, having ribs and a smooth surface, FIG. 1*a* shows the heat sink according to FIG. 1 in a view from the front, FIG. 1*b* shows a cutout of the heat sink in a horizontal sectional plane A-A according to FIG. 1*a*, FIG. 2 shows a perspective view of a heat sink according to the prior art, having ribs and a corrugated surface, FIG. 2*a* shows the heat sink according to FIG. 2 in a view from the front, FIG. 2*b* shows a cutout of the heat sink in a horizontal sectional plane B-B according to FIG. 2*a*, FIG. 3 shows a perspective view of a first embodiment of a heat sink according to the invention, having ribs and a corrugated surface, FIG. 3*a* shows the heat sink according to FIG. 3 in a view from the front, FIG. 3*b* shows a cutout of the heat sink in a horizontal sectional plane C-C according to FIG. 3*a*, FIG. 3*c* shows a cutout of second embodiment of a heat sink according to the invention in a horizontal sectional plane according to FIG. 3*a*, FIG. 4 shows a perspective view of a third embodiment of a heat sink according to the invention, having ribs and a corrugated surface, FIG. 4*a* shows the heat sink according to FIG. 4 in a view from the front, FIG. 4*b* shows a cutout of the heat sink in a horizontal sectional plane D-D according to FIG. 4*a*, FIG. 4*c* shows a cutout of a fourth embodiment of the heat sink in a horizontal sectional plane, FIG. 4*d* shows a cutout of a fifth embodiment of the heat sink in a horizontal sectional plane, FIG. 4*e* shows a fundamental function and a superposition function of the heat sink according to FIG. 4*c*, FIG. 4*f* shows a fundamental function and a superposition function of the heat sink according to FIG. 4*d*, FIG. 5 shows a perspective view of a heat sink according to the prior art, having pins and a smooth surface, FIG. 5*a* shows the heat sink according to FIG. 5 in a view from the front, FIG. 5*b* shows a cutout of the heat sink in a horizontal sectional plane E-E according to FIG. 5 in a view from above, FIG. 6 shows a perspective view of a sixth embodiment of a heat sink according to the invention, having pins and a corrugated surface, FIG. 6*a* shows the heat sink according to FIG. 6 in a view from the front, FIG. 6*b* shows a cutout of the heat sink in a horizontal sectional plane F-F according to FIG. 6 in a view from above, FIG. 7 shows a symbolically illustrated vehicle headlamp, which comprises a heat sink according to the invention.

Exemplary embodiments of the invention are now explained in more detail with reference to FIG. 1 to FIG. 7. In particular, important parts for the invention in a headlamp are illustrated, wherein it is clear that a headlamp also contains many other parts, which are not shown, which allow a sensible use in a motor vehicle, such as a passenger car, motorcycle or lorry in particular. Therefore, electronics, further optical elements, mechanical adjustment devices or holders are for example not shown for the sake of clarity.

In further context, an outer contour of a heat sink means the shaping of the surface of the heat sink.

Typically, a heat sink is produced from a metal, for example aluminium, which is shaped by means of a forming method, such as e.g. extrusion, a casting method such as high-pressure die casting or injection moulding or a CNC milling method. Alternatively, production by means of a 3D metal printing method is conceivable.

For example, the power loss of an electronic component, particularly a power electronics component such as an LED or a power transistor, leads to heat. This must be dissipated in order to prevent functional impairment and possible destruction of the component. Heat sinks, which are in thermal contact with this heat source, improve the dissipation of the heat. Often, heat sinks comprise cooling ribs, in order to enlarge the surface area of the heat sink and improve the efficiency thereof. For a beneficial convection flow on the surface of the heat sink, it is advantageous if the heat sink is arranged with cooling ribs in an installation position, for example in a vehicle headlamp, in such a manner that cooling ribs are orientated vertically.

FIG. 1 shows a heat sink 200 with ribs 201 and a base 203 according to the prior art. In FIG. 1*a*, the heat sink 200 is shown in a side view. FIG. 1*b* shows a cutout, or a cooling rib 201 of the heat sink 200 in a sectional view according to the horizontal sectional plane A-A of FIG. 1*a*, wherein a smooth outer contour of the surface and the thickness or the spacing 205 of the opposite outer surfaces of the rib 201 of the heat sink 200 can be seen.

FIG. 2 shows a heat sink 210 with ribs 211 and a base 213 according to the prior art. In FIG. 2*a*, the heat sink 210 is shown in a side view. FIG. 2*b* shows a cutout, or a cooling rib 211 of the heat sink 210 in a sectional view according to the horizontal sectional plane B-B of FIG. 2*a*, wherein a corrugated outer contour of the surface and the thickness or the spacing 215 of the opposite outer surfaces of the rib 211 of the heat sink 210 can be seen.

FIG. 3 shows a heat sink 100 according to the invention with ribs 101 and a base 103. In FIG. 3*a*, the heat sink 100 is shown in a side view. FIG. 3*b* shows a cutout or a cooling rib 101 of the heat sink 100 in a sectional view according to the sectional plane C-C of FIG. 3*a*, wherein a triangular outer contour of the heat sink 100 can be seen, wherein the outer contour is formed from a superposition of a straight base function, a straight fundamental function and a triangular superposition function, wherein the triangular function has rounded corners, as can be seen in the figure.

The heat sink 100 is suitable for cooling an electronic component of a vehicle headlamp. An intersecting curve, which describes the outer contour of the heat sink 100, lies in a sectional plane C-C according to FIG. 3*a* of the heat sink 100.

The heat sink 100 has a cooling structure with an outer contour, which, as viewed along an imagined sectional plane, follows a contour curve, which can be described in at least one section by means of a contour function.

A fundamental course is formed from a first superposition of a base function and a fundamental function. The contour function is formed from a second superposition of the fundamental course and a superposition function.

The first superposition takes place in that the functional course of the base function forms an axis of a curved, here orthogonal, coordinate system of the fundamental function. The second superposition takes place in that the functional course of the fundamental function forms an axis of a curved, here orthogonal, coordinate system of the superposition function.

The base function has a straight, circular or arc-like course. The fundamental function has a straight or wave-like course. The superposition function has a wave-like course.

A wave-like course may for example mean a course, which can be described by a sine function, the value of a sine function, a triangular function, a sawtooth function or by a periodic semicircle function. Other periodic functions are also possible, particularly those which correspond to the value of a periodically running function.

Exemplary embodiments of the base functions 300, 301, 302, 303, the fundamental functions 310, 311, 312, 313 and the superposition functions 330, 331 332, 333 and the resulting contour functions 350, 351, 352, 353 are shown in FIGS. 4*e* and 4*f*. However, it is to be considered that the contour functions 350, 351, 352, 353 shown are only used for fundamental illustration and are not the mathematically exact implementation of the superpositions of the shown base functions 300, 301, 302, 303, the fundamental functions 310, 311, 312, 313 and the superposition functions 330, 331 332, 333.

The heat sink 100 illustrated in FIG. 3 has a base 103, on which at least two ribs 101 are arranged, which are orientated substantially parallel to one another. The base 103 is used for contacting a heat source, which should be cooled by means of the heat sink 100.

In FIG. 3, two geometric centre lines 106, 107 are shown, of two adjacent cooling ribs 101, which run in a horizontal plane, for example in the sectional plane C-C according to FIG. 3*a*, in the direction of the longitudinal extent of the cooling rib, which enclose a horizontal angle 108, 109 with respect to the horizontal centre line 106, 107, which is smaller than 10°, preferably smaller than 5° and particularly preferably smaller than 1°. The centre line 106 is indicated in FIG. 3*b* and the centre line 116 is indicated in FIG. 3*c*.

The parallel arrangement of the cooling ribs 101 of the heat sink 100 may result from a forming method such as extrusion or a casting method such as high-pressure die casting. It is advantageous however, if the surfaces of the ribs run parallel (with a respectively equal angle 108, 109 of 0° in each case) or at a small angle 108, 109 (smaller than 10°) of the ribs with respect to one another, as a convection flow of rising warm air is also improved as a result.

The ribs 101, starting from the side on which they are connected to one another via the base 103, taper in their cross section along the elevation of the ribs 101 to the open end 104 thereof.

The contour function 350 describes two opposite sides of the outer contour of a cooling rib of the heat sink 100, wherein the sides have a spacing 105 from one another. The superposition function has a periodic course with a superposition period length, wherein the superposition period length is preferably at most half as long, particularly preferably at most a third as long, as the spacing 105.

In this context, the spacing 105 is for example formed by a minimum spacing 105min, a maximum spacing 105max or an average spacing.

FIG. 3*c* shows a second embodiment of the invention in the form of a heat sink 110, having a cooling rib 111 in a horizontal sectional plane (not shown), which corresponds to that of the sectional plane C-C according to FIG. 3*a*, wherein a triangular outer contour of the surface of the cooling rib 111 of the heat sink 110 can be seen, and wherein the triangular outer contours (with rounded corners) of the surface of the cooling rib 111 of the heat sink 110 on two opposite sides of the cooling rib 111 of the heat sink 110 are phase-shifted with respect to those according to FIG. 3*b*. Here, the maxima of the superposition function of the heat sink 110 lie in-phase, whilst the maxima of the heat sink 100 are arranged in a contrary manner. In addition, the spacing 115 of the opposite outer surfaces of the ribs 111 can be seen. The superpositions of the base, fundamental and superposition function are the same as or similar to the example from FIG. 3*b*.

FIG. 4 shows a third example in the form of a heat sink 120 with ribs 121, the open ends 124 thereof and a base 123. In FIG. 4*a*, the heat sink 120 is shown in a side view. FIG. 4*b* shows a cutout of the heat sink 120 in a sectional view according to the horizontal sectional plane D-D according to FIG. 4*a*, wherein a corrugated outer contour of the surface of a cooling rib 121 of the heat sink 120 according to the invention can be seen.

In the sectional plane D-D of the heat sink 120, a form of the intersecting curve can be seen, which is at least partially formed from a superposition of a substantially straight or substantially circular base function and a straight, a wave-like or a triangular fundamental function and a wave-like or the value of a wave-like superposition function.

The superposition is defined in that the functional course of the base function forms an axis of a curved, preferably orthogonal coordinate system of the fundamental function at least in certain sections, and the functional course of the fundamental function forms an axis of a curved, preferably orthogonal coordinate system of the superposition function at least in certain sections.

The heat sink 100 is formed from at least two ribs 101, which are arranged substantially parallel to one another and are connected to one another on a pin side by means of a base 103.

The ribs 121, starting from the side on which they are connected to one another via the base 123, taper in their cross section along the elevation of the ribs 121 to the open end 124 thereof.

The ribs 121 between opposite parts of the outer contour have a spacing 125. The superposition function has a periodic course with a superposition period length, wherein the superposition period length is preferably at most half as long, particularly preferably at most a third as long, as the spacing 125.

In this context, the spacing 125 is for example formed by a minimum spacing, a maximum spacing or an average spacing.

FIG. 4*c* shows a fourth example in the form of a heat sink 130 with ribs 131, a spacing 360 and a base, which is constructed analogously to the preceding embodiments. The sectional image shown corresponds to a sectional plane which is placed in accordance with that of the sectional plane D-D according to FIG. 4*a*. Details about the surface design of the heat sink 130 in connection with a fundamental function 310 are to be drawn when viewed together with FIG. 4*e*, as is explained further below.

In a horizontal sectional plane (not shown) of the heat sink 130, a form of the intersecting curve can be seen, which is at least partially formed from a superposition of a substantially straight or substantially circular base function and a straight, a wave-like or a triangular fundamental function 310 and 311 and a wave-like or the value of a wave-like superposition function 330 and 331.

The superposition is defined in that the functional course of the base function 300 and 301 forms an axis of a curved, preferably orthogonal coordinate system of the fundamental function 310 and 311 at least in certain sections, and the functional course of the fundamental function 310 and 311 forms an axis of a curved, preferably orthogonal coordinate system of the superposition function 330 and 331 at least in certain sections.

In this example, the axis of the coordinate system of the base function 300 and 301 runs straight and the coordinate system of the base function 300 and 301 is orthogonal in origin.

Likewise, the axis of the coordinate system of the fundamental function 310 and 311 runs straight and the coordinate system of the fundamental function 310 and 311 is orthogonal in origin.

The base functions 300 and 301 have a spacing 360.

The fundamental function 310 and 311 has a periodic course with a fundamental period length 320 and 321.

The superposition function 330 and 331 has a periodic course with a superposition period length 340 and 341, wherein the superposition period length 340 and 341 is preferably at most half as long, particularly preferably at most a third as long, as the spacing 360.

The fundamental period length 320 and 321 is at least preferably five-times as long, particularly preferably ten-times as long as the superposition period length 340 and 341.

In this context, the spacing 360 is for example formed by a minimum spacing, a maximum spacing or an average spacing.

FIG. 4*d* shows a fifth example in the form of a heat sink 140 with ribs 141 and a base, which is constructed analogously to the preceding embodiments. The sectional image shown corresponds to a sectional plane which is placed in accordance with that of the sectional plane D-D according to FIG. 4*a*. Details about the surface design of the heat sink 140 in connection with a fundamental function 312 are to be drawn when viewed together with FIG. 4*f*, as is explained further below.

In a horizontal sectional plane (not shown) of the heat sink 140, a form of the intersecting curve can be seen, which is at least partially formed from a superposition of a substantially straight or substantially circular base function and a straight, a wave-like or a triangular fundamental function 312 and 313 and a wave-like or the value of a wave-like superposition function 332 and 333.

The superposition is defined in that the functional course of the base function 302 and 303 forms an axis of a curved, preferably orthogonal coordinate system of the fundamental function 312 and 313 at least in certain sections, and the functional course of the fundamental function 312 and 313 forms an axis of a curved, preferably orthogonal coordinate system of the superposition function 332 and 333 at least in certain sections.

In this example, the axis of the coordinate system of the base function 302 and 303 runs straight and the coordinate system of the base function 302 and 303 is orthogonal in origin.

Likewise, the axis of the coordinate system of the fundamental function 312 and 313 runs straight and the coordinate system of the fundamental function 312 and 313 is orthogonal in origin.

The base functions 302 and 303 have a spacing 361.

The fundamental function 312 and 313 has a periodic course with a fundamental period length 322 and 323.

The superposition function 332 and 333 has a periodic course with a superposition period length 342 and 343, wherein the superposition period length 342 and 343 is preferably at most half as long, particularly preferably at most a third as long, as the spacing 361.

The fundamental period length 322 and 323 is at least preferably five-times as long, particularly preferably ten-times as long as the superposition period length 342 and 343.

In this context, the spacing 361 is for example formed by a minimum spacing, a maximum spacing or an average spacing.

The triangular fundamental function 312 and 313, and the wave-like superposition function 332 and 333 run differently from their form in each case.

FIG. 5 shows a heat sink 220 with pins 222, the open ends 224 thereof and a base 223 according to the prior art. In FIG. 5*a*, the heat sink 220 is shown in a side view. FIG. 5*b* shows a cutout of the heat sink 220 in a sectional view according to the horizontal sectional plane E-E according to FIG. 5*a*, wherein a smooth outer contour of the surface and a spacing or diameter 225 of a pin 222 of the heat sink 220 can be seen.

FIG. 6 shows a heat sink 150 according to the invention, having pins 152, the open ends 154 thereof and a base 153. In FIG. 6*a*, the heat sink 150 is shown in a side view. FIG. 6*b* shows a cutout of the heat sink 150 in a sectional view according to the horizontal sectional plane F-F according to FIG. 6*a*, wherein a corrugated or triangular outer contour (with rounded corners) of the surface of the heat sink 150 according to the invention can be seen.

The pins 152, starting from the side on which they are connected to one another via the base 153, taper in their cross section along the elevation of the pins 152 to the open end 154 thereof.

The pins 152 have a diameter or a spacing 155 between opposite parts of their outer contour. In this context, the spacing 155 is for example formed by a minimum spacing, a maximum spacing or an average spacing.

A vehicle headlamp 10 is illustrated symbolically in FIG. 7, which comprises a lamp 11, power electronics 12, heat sink 100 and an optical system 13.

The lamp 11 is for example formed from one or more LEDs or laser diodes. The power electronics 12 for example contain driving transistors for LEDs as lamps 11.

The lamp 11 and the power electronics 12 are preferably connected via a contact element 14, for example a mica washer or a mass of thermal compound which improves the thermal resistance and as a result ensures a good thermal coupling of the heat source to the heat sink, to a heat sink 100 according to the invention.

The optical system 13 may comprise one or more optical elements, for example in the form of lenses, apertures or transparent covers.

REFERENCE LIST

100, 110, 120, 130, 140,
150, 200, 210, 220 Heat sink
101, 111, 121, 131, 141,
152, 201, 211, 222 Rib or pin of the heat sink
103, 123, 153, 203, 213, 223 Base of the heat sink
104, 124, 154 Open end of the rib or the pin
105, 105min, 105max,
115, 125, 155,
205, 215, 225, 360, 361 Spacing
106, 107, 116 Centre line
108, 109 Angle
300, 301, 302, 303 Base function
310, 311, 312, 313 Fundamental function
320, 321, 322, 323 Fundamental period length
330, 331, 332, 333 Superposition function
340, 341, 342, 343 Superposition period length
350, 351, 352, 353 Contour function
10 Vehicle headlamp
11 Lamp
12 Power electronics
13 Optical system
14 Contact element
15 Light ray

The invention claimed is:

1. A heat sink (100, 110, 120, 130, 140, 150) for cooling an electronic component of a vehicle headlamp (10), the heat sink (100, 110, 120, 130, 140, 150) comprising:

a cooling structure comprising a base (103, 123, 153, 203, 213, 223) on which at least two ribs (101, 111, 121, 131, 141) are arranged, the base having an outer contour, which, as viewed along an imagined sectional plane, follows a contour curve, which can be described in at least one section by means of a contour function (350, 351, 352, 353), wherein a fundamental course is formed from a first superposition of a base function (300, 301, 302, 303) and a fundamental function (310, 311, 312, 313), and the contour function (350, 351, 352, 353) is formed from a second superposition of the fundamental course and a superposition function (330, 331, 332, 333), wherein the first superposition takes place in that the functional course of the base function (300, 301, 302, 303) forms an axis of a curved coordinate system of the fundamental function (310, 311, 312, 313), and the second superposition takes place in that the functional course of the fundamental function (310, 311, 312, 313) forms an axis of a curved coordinate system of the superposition function (330, 331, 332, 333), wherein the base function (300, 301, 302, 303) has a straight course, the fundamental function (310, 311, 312, 313) has a straight course, and the superposition function (330, 331, 332, 333) has a triangular course, wherein the contour function (350, 351, 352, 353) also describes two opposite sides of the outer contour of the heat sink (100, 110, 120, 130, 140, 150), which have a spacing (105, 115, 125, 155, 360, 361) with respect to one another, and the superposition function (330, 331, 332, 333) has a periodic course with a superposition period length (340, 341, 342, 343), and wherein the superposition period length is at most a third as long as the spacing.

2. The heat sink (100, 110, 120, 130, 140, 150) according to claim 1, wherein the fundamental function (310, 311, 312, 313) has a periodic course with a fundamental period length (320, 321, 322, 323) and the superposition function (330, 331, 332, 333) has a periodic course with a superposition period length (340, 341, 342, 343), wherein the fundamental period length (320, 321, 322, 323) is at least five-times as long as the superposition period length (340, 341, 342, 343).

3. The heat sink (100, 110, 120, 130, 140, 150) according to claim 1, wherein the fundamental function (310, 311, 312, 313) and the superposition function (330, 331, 332, 333) run differently in each case, either in a wave-like manner, from the value of wave-like or triangular.

4. A vehicle headlamp (10), comprising:

a lamp (11) and/or power electronics (12) and an optical system (13); and the heat sink (100, 110, 120, 130, 140, 150) according to claim 1, wherein the lamp (11) and/or the power electronics (12) is/are thermally coupled to the heat sink (100, 110, 120, 130, 140, 150).

5. The heat sink according to claim 1, wherein the functional course of the base function (300, 301, 302, 303) forms an axis of a curved, orthogonal coordinate system of the fundamental function (310, 311, 312, 313), and the functional course of the fundamental function (310, 311, 312, 313) forms an axis of a curved, orthogonal coordinate system of the superposition function (330, 331, 332, 333).

6. The heat sink according to claim 1, wherein the contour function (350, 351, 352, 353) describes two opposite sides of the outer contour of ribs (101, 111, 121, 131, 141) or pins (152) of the heat sink (100, 110, 120, 130, 140, 150), which have a spacing (105, 115, 125, 155, 360, 361) with respect to one another.

7. The heat sink according to claim 1, wherein the superposition period length (340, 341, 342, 343) is at most half as long as the spacing (105, 115, 125, 155, 360, 361).

8. The heat sink according to claim 1, wherein the superposition period length (340, 341, 342, 343) is at most a third as long as the spacing (105, 115, 125, 155, 360, 361).

9. The heat sink according to claim 2, wherein the fundamental period length (320, 321, 322, 323) is at least ten-times as long as the superposition period length (340, 341, 342, 343).

* * * * *